US006044678A

United States Patent [19]

Olszewski

[11] Patent Number: 6,044,678

[45] Date of Patent: Apr. 4, 2000

[54] METHOD AND DEVICE FOR MANUFACTURING A TUBULAR HOLLOW BODY WITH SPACED-APART INCREASED DIAMETER PORTIONS

[75] Inventor: Egon Olszewski, Paderborn, Germany

[73] Assignee: Benteler AG, Paderborn, Germany

[21] Appl. No.: 09/266,141

[22] Filed: Mar. 10, 1999

[30] Foreign Application Priority Data

Mar. 11, 1998 [DE] Germany ..... 198 10 422

[51] Int. Cl.[7] ..... B21D 15/06; B21D 26/02

[52] U.S. Cl. ..... 72/59; 72/62; 29/421.1

[58] Field of Search ..... 72/59, 62, 61; 29/421.1

[56] References Cited

U.S. PATENT DOCUMENTS

| | | | |
|---|---|---|---|
| 3,130,771 | 4/1964 | Peyton | 72/59 |
| 4,319,471 | 3/1982 | Benteler et al. | 72/62 |
| 4,840,053 | 6/1989 | Nakamura | 72/62 |
| 4,996,857 | 3/1991 | Kageyama et al. | 72/59 |
| 5,481,892 | 1/1996 | Roper et al. | 72/62 |

*Primary Examiner*—David Jones
*Attorney, Agent, or Firm*—Friedrich Kueffner

[57] ABSTRACT

A method and a device for manufacturing a tubular hollow body with increased diameter portions which are arranged at a distance from each other using the internal high pressure deformation process. Initially an internal portion of the hollow body is sealed off at one end thereof and is supported on the inside at the other end thereof and in this internal portion is formed an increased diameter portion by a hydraulic internal high pressure while axially advancing the hollow body, and subsequently, after axially reversing the hollow body within the shaping tool, another increased diameter portion is manufactured in the same manner.

6 Claims, 4 Drawing Sheets

1d
29
30
32

29
30
32
33

15
24
21'
22
L
23
21
17

METHOD AND DEVICE FOR MANUFACTURING A TUBULAR HOLLOW BODY WITH SPACED-APART INCREASED DIAMETER PORTIONS

BACKGROUND OF THE INVENTION

1. Field of the Invention

The present invention relates to a method of manufacturing a tubular hollow body with increased diameter portions which are arranged at a distance from each other, wherein the method uses the internal high pressure deformation process, and to a device for carrying out the method.

2. Description of the Related Art

It is known in the art to shape or deform tubular hollow bodies by means of the internal high pressure deforming or shaping process. For example, EP 0 439 764 B1 describes a method of manufacturing hollow single-part work pieces of metal. In this method, an initially tubular hollow body is widened under the pressure of a liquid while simultaneously axially feeding or forwardly moving the hollow body and pressing the hollow body against the die of a divided shaping tool.

The length of the hollow body to be deformed is limited because the free buckling length increases with the length of the hollow body and axial feeding without simultaneous increase of the internal pressure would lead to the formation of creases in the hollow body. In addition, when increasing the internal pressure, the holding force necessary in the case of longer lengths increases significantly. This, in turn, results in increased manufacturing costs. Accordingly, this known method has its limits, particularly when more than two increased diameter portions are to be manufactured in one work step.

In addition, U.S. Pat. No. 4,788,843 discloses a method and a device for hydraulically shaping a tubular hollow body in which more than two bulges or increased diameter portions can be produced in a hollow body in one work step. For this purpose, the hollow body is placed in a shaping tool, is secured in its position by means of mandrels at the ends of the hollow body and is sealed. Fluid is subsequently filled into the hollow body through the mandrels at the ends. Subsequently, pressing pistons are pushed through the mandrels into the hollow body, so that the required hydraulic internal pressure is built up and the increased diameter portions are formed. U-shaped hollow bodies can also be processed in th is manner.

However, independently of whether the hollow body is straight or curved, this method has the disadvantage that the wall thickness of the hollow body inevitably is decreased in the areas of the radially expanded portions. Consequently, this method can only be used for manufacturing those products in which the requirements with respect to accuracy to size and strength in the deformed areas is of minor importance.

Finally, when using this method, the length of the hollow body which can be processed is limited.

SUMMARY OF THE INVENTION

Therefore, it is the primary object of the present invention to provide an improved method for manufacturing tubular hollow bodies with several increased diameter portions which are spaced apart from each other by using the internal high pressure deforming process, while avoiding undue decreases of wall thickness at the increased diameter portions.

Another object is to provide a device suitable for carrying out the method.

In accordance with the present invention, initially an internal portion of the hollow body is sealed off at one end thereof and is supported on the inside at the other end thereof and in this internal portion is formed an increased diameter portion by means of a hydraulic internal high pressure while axially advancing the hollow body, and subsequently, after axially reversing the hollow body within the shaping tool, another increased diameter portion is manufactured in the same manner.

Accordingly, the gist of the invention is the fact that the increased diameter portions in the hollow body are formed in sections.

By using the method according to the present invention, it is possible to manufacture several increased diameter portions in the longitudinal direction of a hollow body which may have practically any desired length. By manufacturing the increased diameter portions in sections, buckling of the hollow body is not possible. By axially moving or advancing the hollow body after each expanding process, the wall thickness of the hollow body is not unduly reduced. By supporting the hollow body on the inside, the formation of creases of the portion of the hollow body which is under axial pressure is suppressed. The hydraulic pressure required for the deformation can be reduced. This results in a reduction of the required holding forces in the shaping tool; this has an advantageous effect on the manufacturing costs. The wear of the tool is also reduced.

The shape and geometry of the increased diameter portions can be selected in accordance with specific requirements by selecting appropriate dies in the shaping tool. The increased diameter portions can be manufactured unilaterally and radially at the hollow body or they can be manufactured circumferentially in the shape of a ring. The increased diameter portions can also be arranged circumferentially offset relative to each other. Consequently, the method according to the present invention is particularly suitable for the manufacture of, for example, hollow cam shafts; thus, the cam shafts can be manufactured efficiently and economically in this manner.

In accordance with a feature of the present invention, the hydraulic internal high pressure is applied from the supported or braced end of the hollow body. This method not only leads to an increase in the efficiency of the method, but also improves the free selection of shapes when manufacturing the hollow bodies with respect to the length of the hollow bodies or possible bending operations of the hollow body.

In accordance with another feature, the hollow body is bent between the manufacture of two increased diameter portions. This makes it possible to repeatedly shape and bend the hollow body in order to manufacture hollow bodies of almost any desired length having several bends and increased diameter portions.

In accordance with another feature, one or more of the increased diameter portions can be opened at the end faces thereof. This can be carried out in various ways, preferably by a shearing cut technology, for example, by punching. By opening the increased diameter portions, collars are formed at the hollow body.

The device for carrying out the method includes a two-part shaping tool and a sealing mandrel which can be placed against the end face of the hollow body. A sealing and supporting tool which can be inserted into the hollow body includes a sealing head and a support member, wherein the sealing and supporting tool and the support member can be positioned in their axial positions within the hollow body, and wherein a guide rod extending through the support member with radial play can move the sealing head and place the sealing head against the inner surface of the hollow body, so that the sealing head is in contact with the inner surface of the hollow body in a manner which is tight with respect to media.

By making it possible to correctly position the support member and the sealing head, the length of the tubular hollow body and the length of the internal portion can be freely selected because the length of the internal portion varies with the axial length of the increased diameter portions.

In accordance with the present invention, the sealing head is composed of two plates which can be displaced relative to each other and a sealing insert arranged between the plates. When the two plates are pressed together, the sealing insert forms a circumferential sealing bead which serves as a sealing ring and closes the hollow body in a media-tight manner.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

FIGS. 1–8 show a tubular hollow body 1, 1*a*–1*e* in various stages of manufacture. The Figures are technically simplified and are not drawn to scale.

Figure 1:
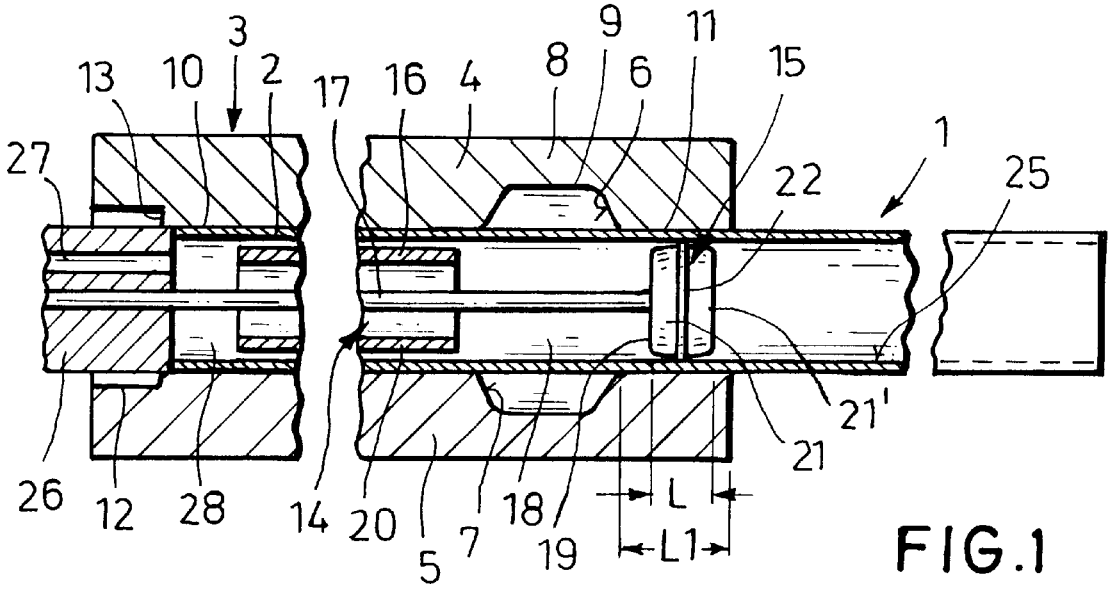
FIG. 1 is a vertical sectional view of the device according to the present invention with a portion of the tubular hollow body prior to the deforming process.

FIG. 1 shows the tubular hollow body 1 in its initial position. A length portion 2 of the tubular hollow body 1 is received by a shaping tool 3 which is formed of an upper die 4 and a lower die 5. The dies 4, 5 have a contour 6, 7 for the hydraulic deformation of the tubular hollow body 1. For this purpose, the shaping tool 3 is provided in the length portion 8 with a radial expansion 9. The contour portions 10, 11 adjacent this expansion 9 support the outer side of the length portion 2 of the tubular hollow body 1 which is surrounded by the shaping tool 3. The shaping tool 3 is open at the end of the length portion 2 and has at the opening thereof a radial expansion 12 with a conically shaped transition 13.

A sealing and supporting tool 14 is paced in the length portion 2 of the hollow body 1. The sealing and supporting tool 14 includes a sealing head 15, a support member 16 and a guide rod 17. The sealing head 15 and the support member 16 can each be positioned in their axial positions in the hollow body 1. For effecting this positioning, the sealing head 15 is connected to the guide rod 17 which extends through the support member 16 with radial play.

An internal portion 18 located in the length portion 8 is sealed by means of the sealing and supporting tool 14 at an end 19 by the sealing head 15 and is supported at the other end 20 by the support member 16.

Figures 7, 8, 9:
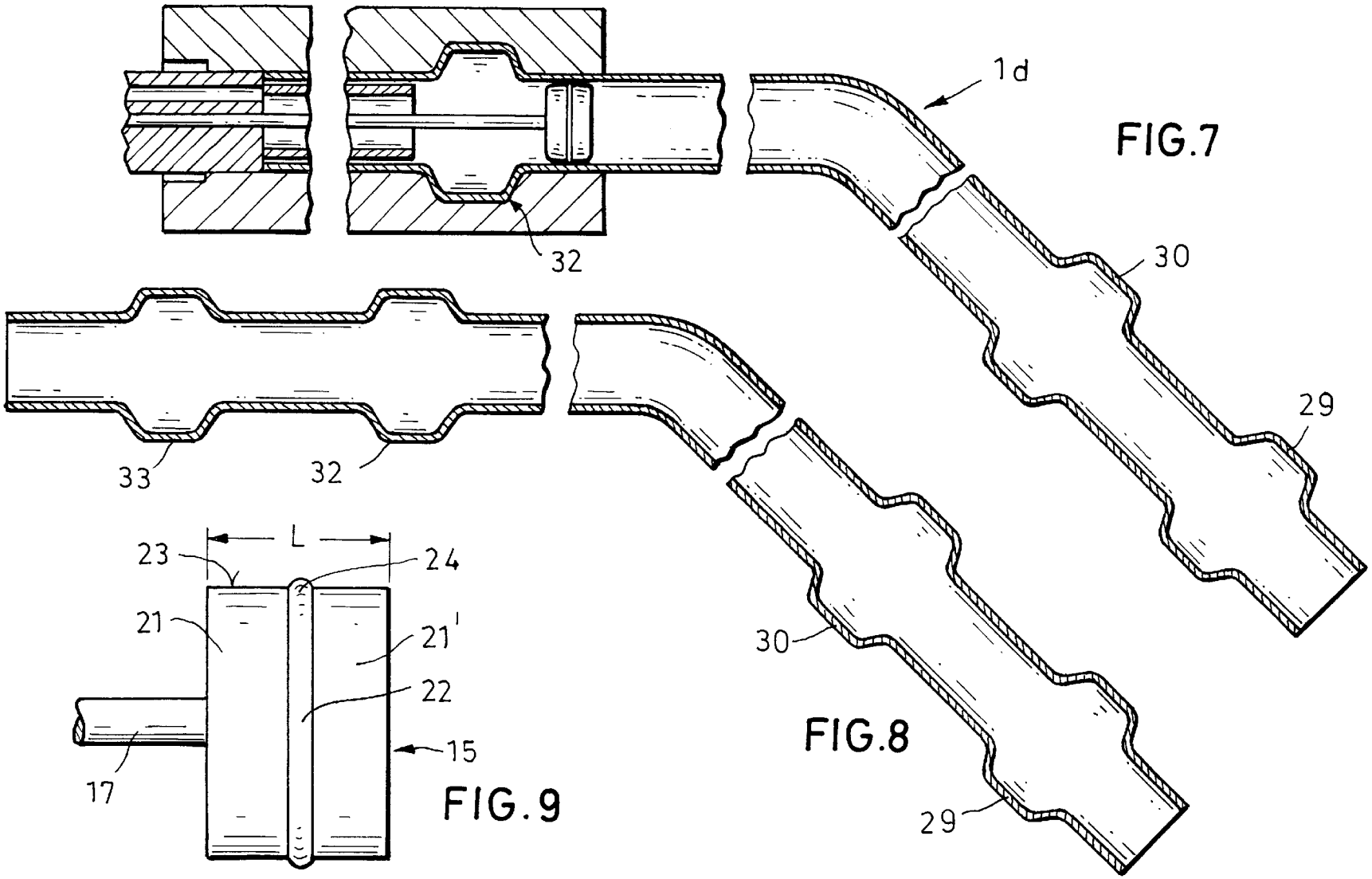
FIG. 7 is a sectional view, similar to FIG. 6, shown during the deforming process.
FIG. 8 is a vertical longitudinal sectional view showing the expanded and bent hollow body in the final state thereof.
FIG. 9 is a partial longitudinal sectional view showing a sealing head.

The sealing head 15 includes 2 plates 21, 21' which can be displaced relative to each other and a sealing insert 22 between the plates 21, 21', as also shown in FIG. 9. By displacing the plates 21, 21' relative to each other in the axial direction, the sealing insert 22 forms a sealing bead 24 which extends circumferentially on the radially outer side 23 of the sealing head 15, wherein the sealing bead 24 rests against the inner surface 25 of the hollow body 1 and clamps the sealing head 15. The axial length L of the sealing head 15 does not exceed two thirds of the length L1 of the contour section 11 of the shaping tool 3.

For manufacturing an increased diameter portion of the hollow body 1, a piston-like sealing mandrel 26 seals the length portion 2 of the tubular hollow body 1 in a media-tight manner at the end thereof. Through an axial duct 27 extending through the sealing mandrel 26, a hydraulic internal high pressure is built up in the length portion 28 sealed by the sealing head 15 and the sealing mandrel 26, wherein the length portion 28 also includes the internal portion 18.

Figure 2:
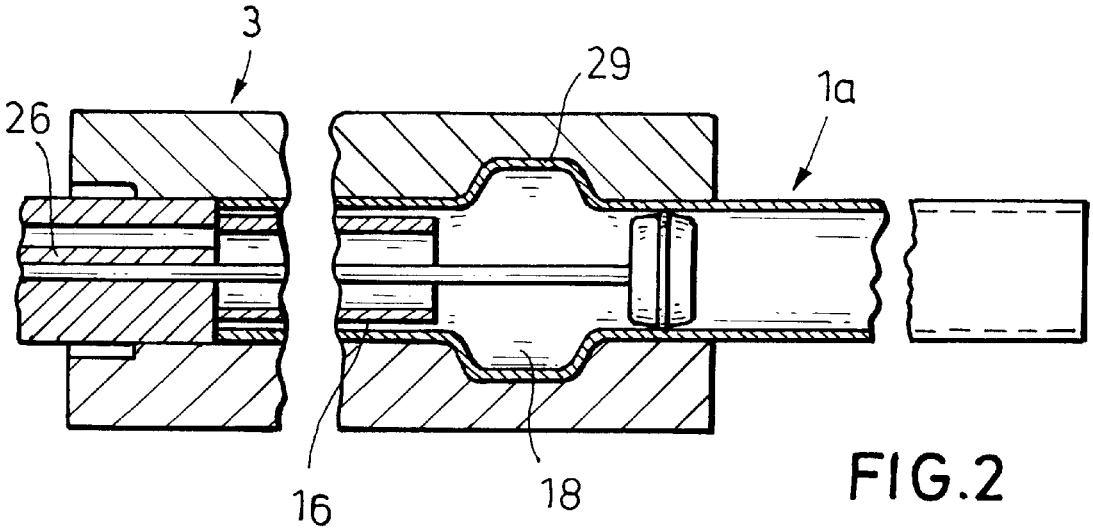
FIG. 2 is a vertical sectional view, similar to FIG. 1, shown during the deforming process.

FIG. 2 shows in a vertical longitudinal sectional view the device of FIG. 1 during the deformation process of the tubular hollow body 1. The sealing mandrel 26 pushes the tubular hollow body 1 axially in the direction of the internal portion 18, wherein the simultaneously introduced hydraulic internal high pressure leads to the formation of an increased diameter portion 29 in the hollow body 1*a*. The support member 16 prevents buckling of the hollow body 1*a* during the axial movement thereof. Because of this axial movement undue material thickness decreases in the area of the increased diameter portion 29 are avoided.

Figure 3:
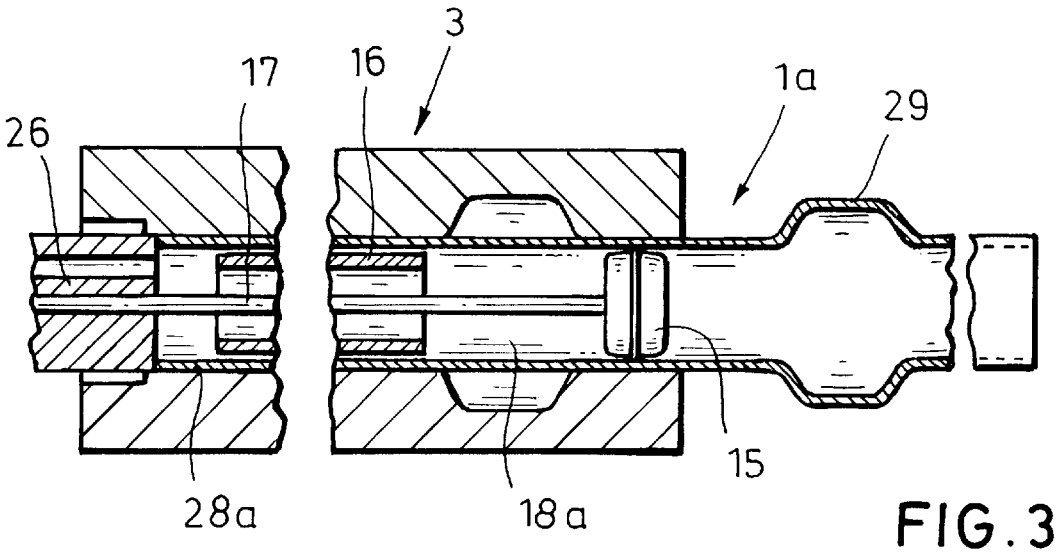
FIG. 3 is a sectional view, similar to FIG. 1, showing the device and the hollow body before the manufacture of a second increased diameter portion.

In the next manufacturing step shown in FIG. 3, the deformed hollow body 1*a* has been reversed or turned axially and toward the right as seen in the drawing, and the sealing mandrel 26 forms with the sealing head 15 and new length portion 28*a* and the sealing head 15 forms with the support member 17 an internal portion 18*a*.

Figure 4:
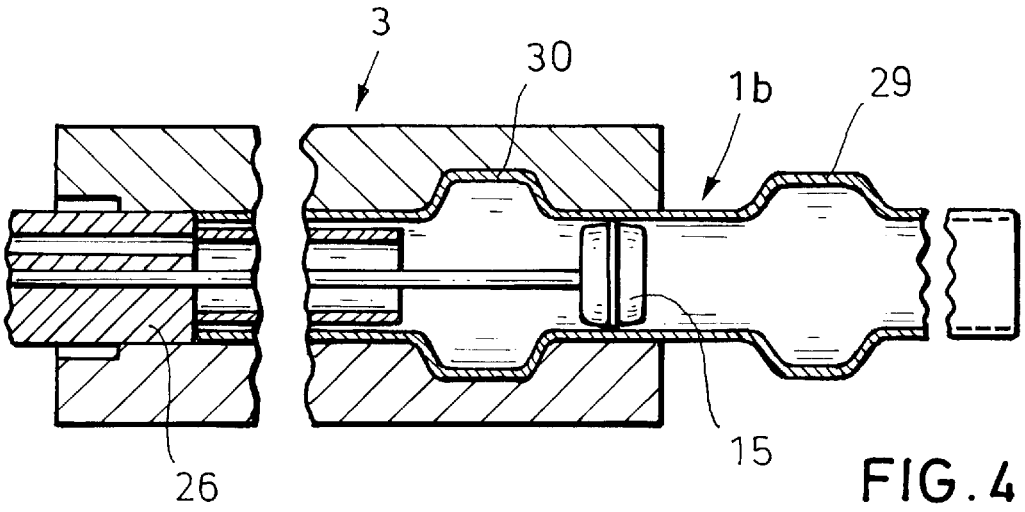
FIG. 4 is a sectional view, similar to FIG. 3, shown during the deforming process.

FIG. 4 shows how during the further manufacturing sequence a second increased diameter portion 30 is produced in the tubular hollow body 1*b*. The deforming process is identical to the process described in connection with FIG. 2.

Figures 5, 6:
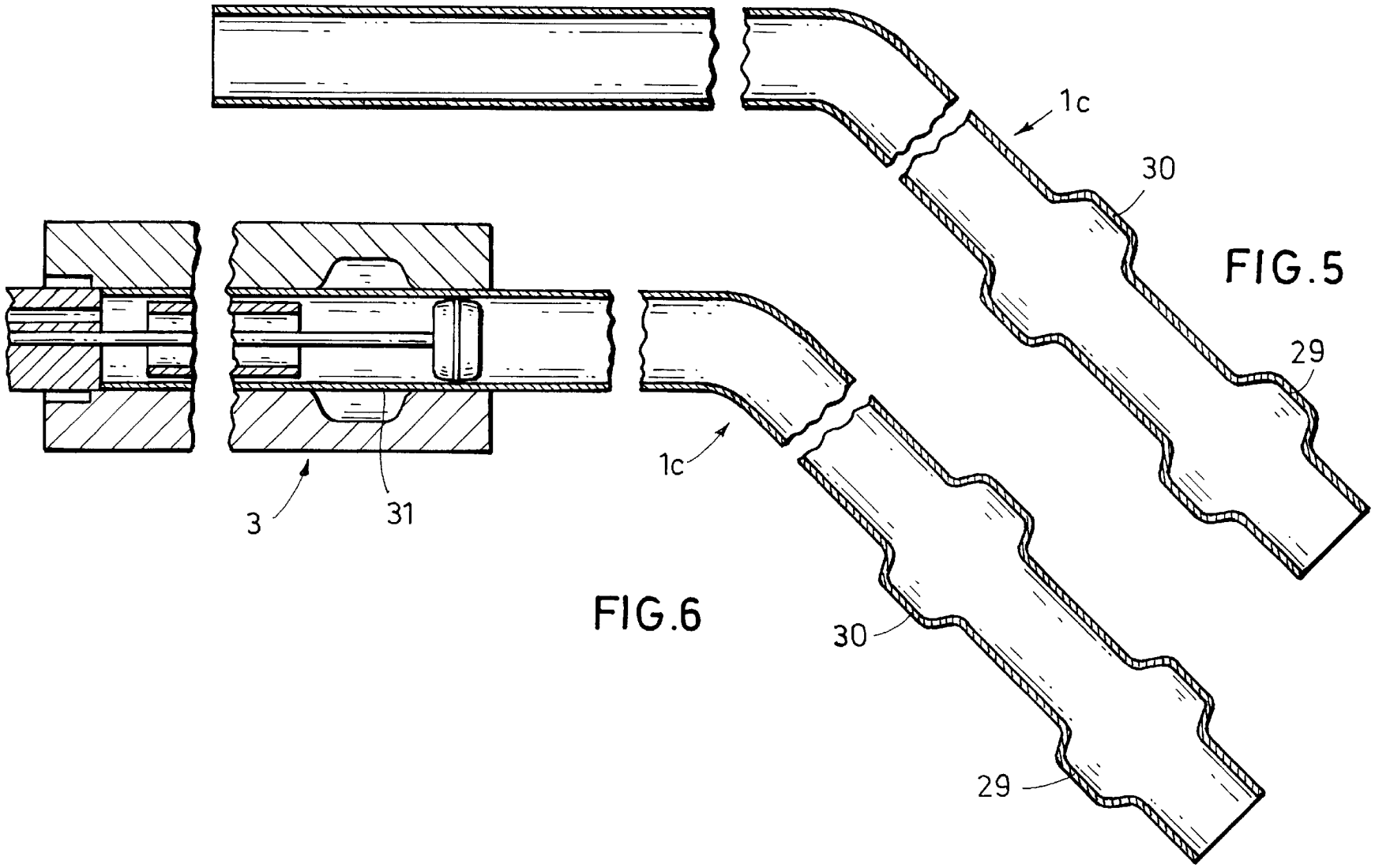
FIG. 5 is a vertical longitudinal sectional view showing the hollow body after a bending process.
FIG. 6 is a vertical longitudinal sectional view of the hollow body and the device prior to another deforming process.

FIG. 5 shows the hollow body 1*c* which is obtained after carrying out a bending process on the hollow body 1*b* of FIG. 4.

The end portion 31 of the hollow body 1*c* which has not been deformed is placed in the shaping tool as shown in FIG. 6.

FIG. 7 shows the same deformation as carried out in accordance with FIG. 2, so that an additional increased diameter portion 32 is produced.

In accordance with the manufacturing steps in FIGS. 3 and 4, the hollow body 1*d* is axially reversed and a last increased diameter portion 33 is produced.

FIG. 8 shows in a vertical longitudinal sectional view the tubular hollow body 1*e* as it is obtained by carrying out the manufacturing steps illustrated in FIGS. 1–7, by means of the internal high pressure deformation process. The hollow body 1*e* provided with bends and increased diameter portions 29, 30, 32, 33 can then be conveyed to any required further processing steps.

While specific embodiments of the invention have been described in detail to illustrate the inventive principles, it will be understood that the invention may be embodied otherwise without departing from such principles.

I claim:

1. A method of manufacturing a tubular hollow body having increased diameter portions spaced apart in a longitudinal direction of the hollow body using an internal high pressure deforming process in a two-part shaping tool while externally supporting at least portions of the hollow body, the method comprising the method steps of sealing an internal portion of the hollow body at one end thereof and internally bracing the internal portion at another end thereof, producing in the internal portion an increased diameter portion by applying a hydraulic internal high pressure, and simultaneously axially moving the hollow body, and, after axially reversing the hollow body within the shaping tool, repeating the method steps.

2. The method according to claim 1, comprising applying the hydraulic internal high pressure from the another braced end of the hollow body.

3. The method according to claim 1, comprising bending the hollow body between manufacturing two increased diameter portions.

4. The method according to claim 1, comprising opening the increased diameter portions at end faces thereof.

5. A device for manufacturing a hollow tubular body with increased diameter portions arranged spaced apart from each other in a longitudinal direction of the hollow body using an internal high pressure deformation process, the device comprising a two-part shaping tool for externally supporting at least portions of the hollow body, a sealing and supporting tool insertable into the hollow body comprising a sealing head and support member configured to be positionable within the hollow body in an axial position, a guide rod extending with axial play through the support member for displacing the sealing head, wherein the sealing head is configured to be placed media-tight against an inner surface of the hollow body.

6. The device according to claim 5, wherein the sealing head comprises two plates which are displaceable relative to each other and a sealing insert placed between the plates.

* * * * *